US005683172A

United States Patent [19]

Huag

[11] Patent Number: 5,683,172

[45] Date of Patent: Nov. 4, 1997

[54] DECORATIVE LIGHT ASSEMBLY

[76] Inventor: Shun-Feng Huag, No 13, Lane 84, Na Fu Rd., Hsinchu City, Taiwan

[21] Appl. No.: 716,743

[22] Filed: Sep. 23, 1996

[51] Int. Cl.[6] ..... F21D 1/00

[52] U.S. Cl. ..... 362/252; 362/124; 362/226; 362/808

[58] Field of Search ..... 362/249, 250, 362/251, 252, 808, 806, 226, 811, 227, 124, 122, 121, 388, 391; 40/442–444

[56] References Cited

U.S. PATENT DOCUMENTS

| | | | |
|---|---|---|---|
| 4,339,787 | 7/1982 | Burnbaum | 362/252 |
| 5,150,964 | 9/1992 | Tsui | 362/251 |
| 5,379,202 | 1/1995 | Daun | 362/808 |
| 5,430,626 | 7/1995 | Leffel | 362/252 |
| 5,577,831 | 11/1996 | Chang | 362/252 |

*Primary Examiner*—James C. Yeung
*Attorney, Agent, or Firm*—Varndell Legal Group

[57] ABSTRACT

A decorative light assembly including a plurality of unit lamp carrier frames connected together into a three-dimensional patter by fitting respective lugs and coupling rods into respective plug holes and coupling sockets, a plurality of electric sockets mounted in the unit carrier frames to hold a respective bulb, and an electric plug connected in series to the lamp sockets and adapted for connecting to an electric socket, the electric plug having cartridge fuses connected in series to the metal contact blades thereof, and a packing plate fixed to a front opening thereof to hold down the cartridge fuses and to seal out water.

2 Claims, 9 Drawing Sheets

DECORATIVE LIGHT ASSEMBLY

BACKGROUND AND SUMMARY OF THE INVENTION

The present invention relates to a decorative light assembly which is formed by connecting a plurality of unit light carrier frames into a three-dimensional pattern by means of plug joints.

Various decorative light assemblies have been disclosed, and have appeared on the market. These decorative light assemblies are commonly comprised of a light carrier frame made in the form of a particular pattern, a plurality of lamp sockets mounted in the light carrier frame and connected in series to an electric plug adapted for connecting to power supply, and a plurality of bulbs respectively mounted in the lamp sockets. Because the light carrier frames of regular decorative light assemblies are commonly injection molded from plastic, it has a limited size. Furthermore, because the light carrier frames of conventional decorative light assemblies have a respective pattern which is not changeable, the consumer can not assemble a decorative light assembly into a different pattern.

The present invention has been accomplished under the circumstances in view. It is one object of the present invention to provide a decorative light assembly which can be assembled by the consumer in a flat pattern or a three-dimensional pattern as desired. It is another object of the present invention to provide a decorative light assembly which can be assembled into any of a variety of forms by the consumer. It is still another object of the present invention to provide an electric plug for a decorative light assembly which effectively prohibits water from passing to the inside. According to the preferred embodiment of the present invention, the decorative light assembly comprises a plurality of unit lamp carrier frames connected together into a three-dimensional patter by fitting respective lugs and coupling rods into respective plug holes and coupling sockets, a plurality of electric sockets mounted in the unit carrier frames to hold a respective bulb, and an electric plug connected in series to the lamp sockets and adapted for connecting to an electric socket, the electric plug having cartridge fuses connected in series to the metal contact blades thereof, and a packing plate fixed to a front opening thereof to hold down the cartridge fuses and to seal out water.

DETAILED DESCRIPTION OF THE PREFERRED EMBODIMENT

Figure 5:
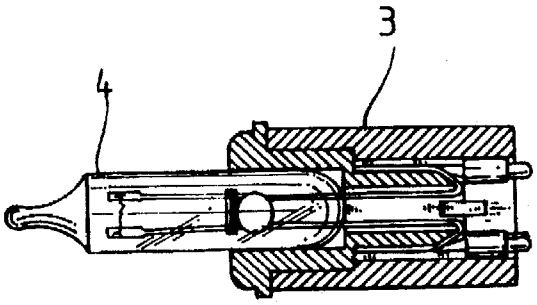
FIG. 5 is a sectional view of a lamp socket and a bulb according to the present invention.
Figure 3:
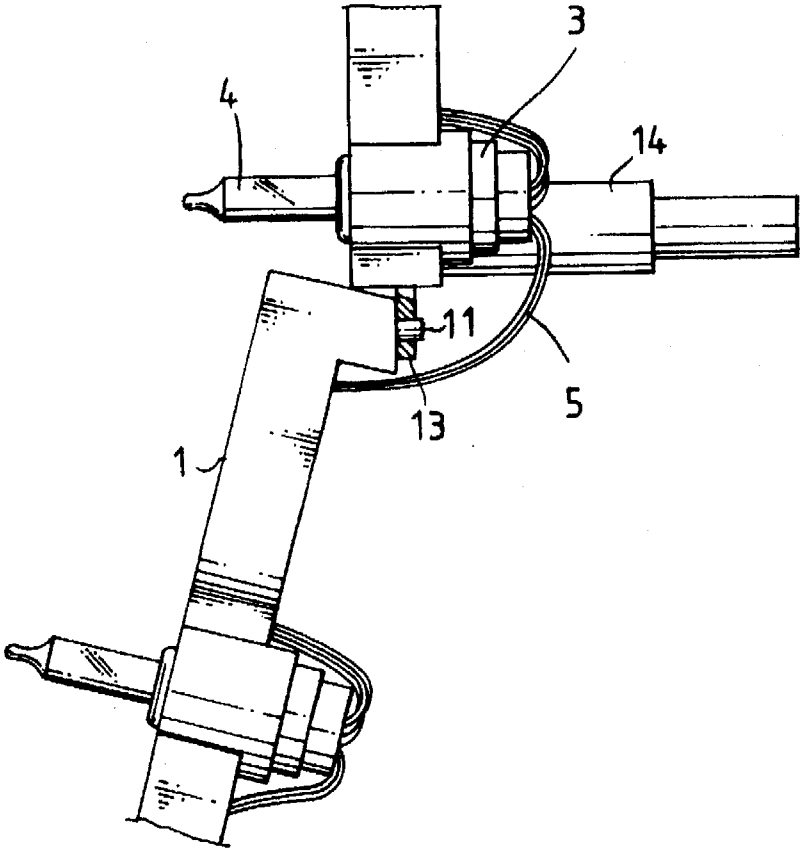
FIG. 3 shows two unit light carrier frames connected in a plane according to the present invention.
Figure 6:
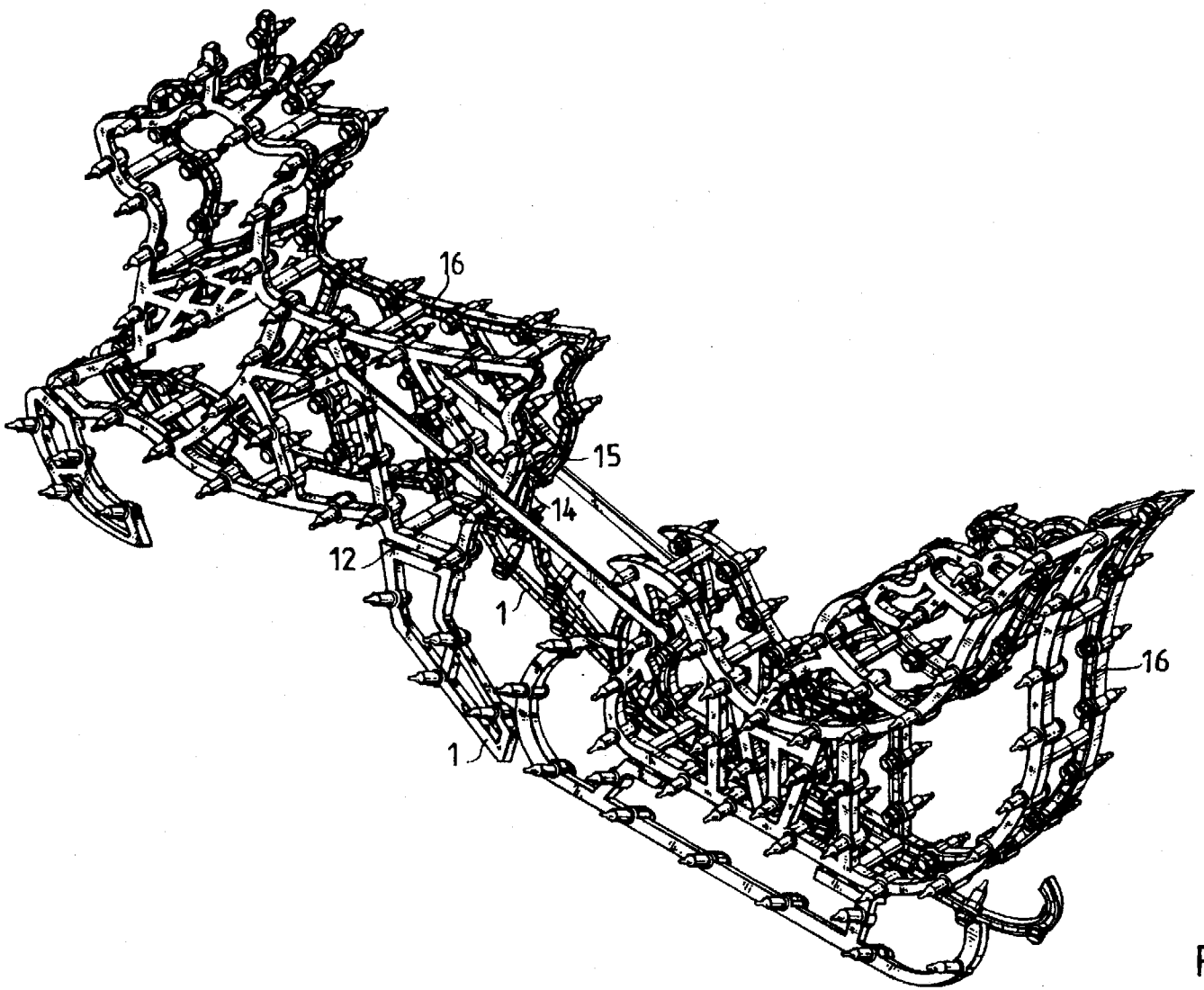
FIG. 6 is an elevational view of a decorative light assembly according to the present invention.
Figure 7:
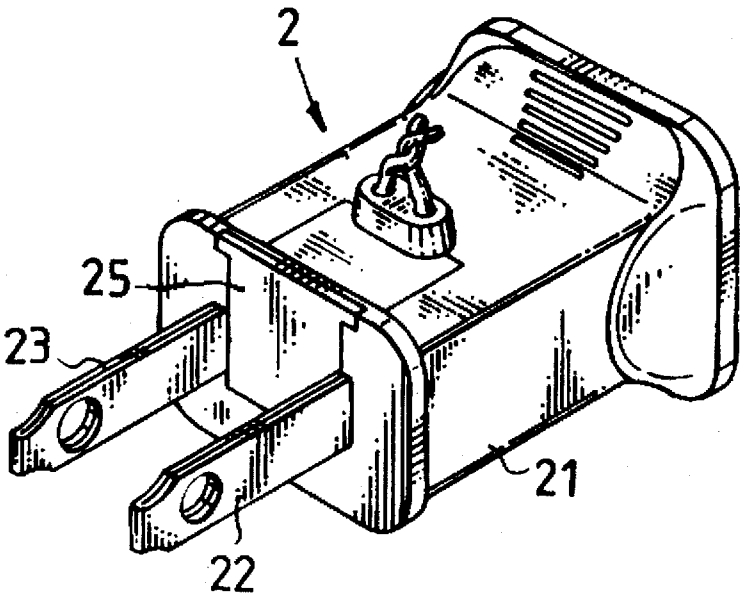
FIG. 7 is an elevational view of an electric plug according to the present invention.
Figure 8:
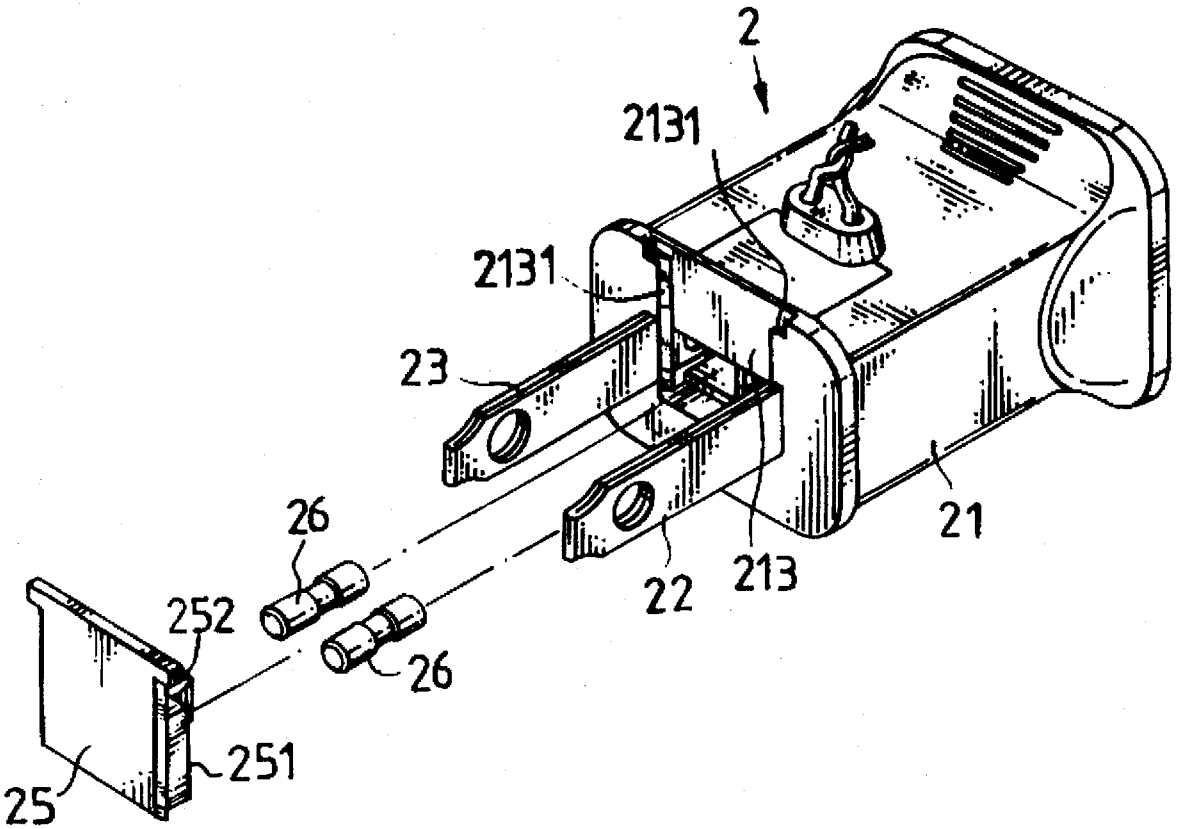
FIG. 8 is an exploded view of the electric plug shown in FIG. 7.
Figure 10:
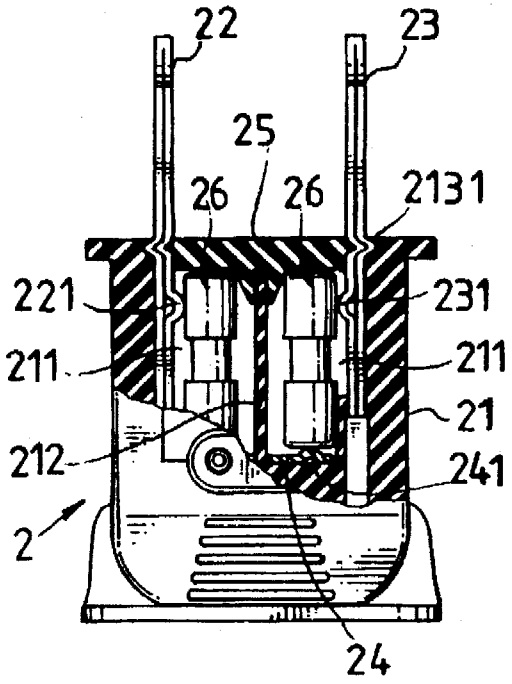
FIG. 10 is a top view in section of the electric plug shown in FIG. 7.
Figure 9:
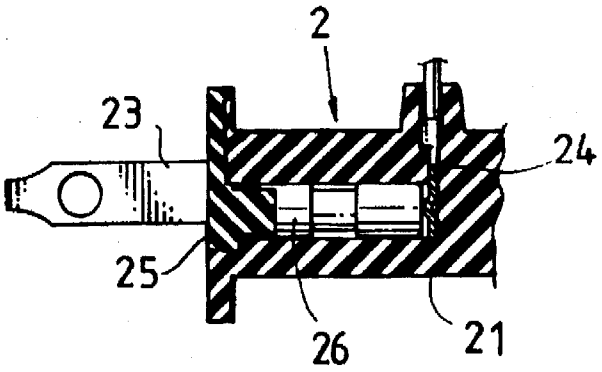
FIG. 9 is a side view in section of the electric plug shown in FIG. 7.
Figure 11:
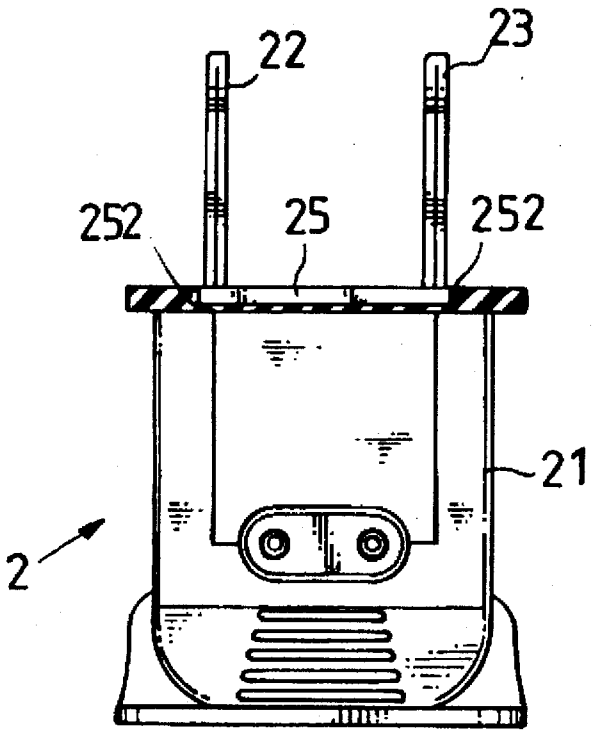
FIG. 11 is a top plain view of the electric plug shown in FIG. 7.

Referring to Figures from 1 to 6, a decorative light assembly in accordance with the present invention is generally comprised of a plurality of unit lamp carrier frames 1 connected together in different directions to ford a decorative pattern (see FIG. 6), and an electric plug 2. The unit lamp carrier frames 1 is mounted with a plurality of lamp sockets 3, which are connected in series to the electric plug 2 by electric wires 5, and bulbs 4 mounted in the lamp sockets 3 and disposed at the front side of each unit lamp carrier frames 1 (see FIGS. 3 and 5).

Figure 1:
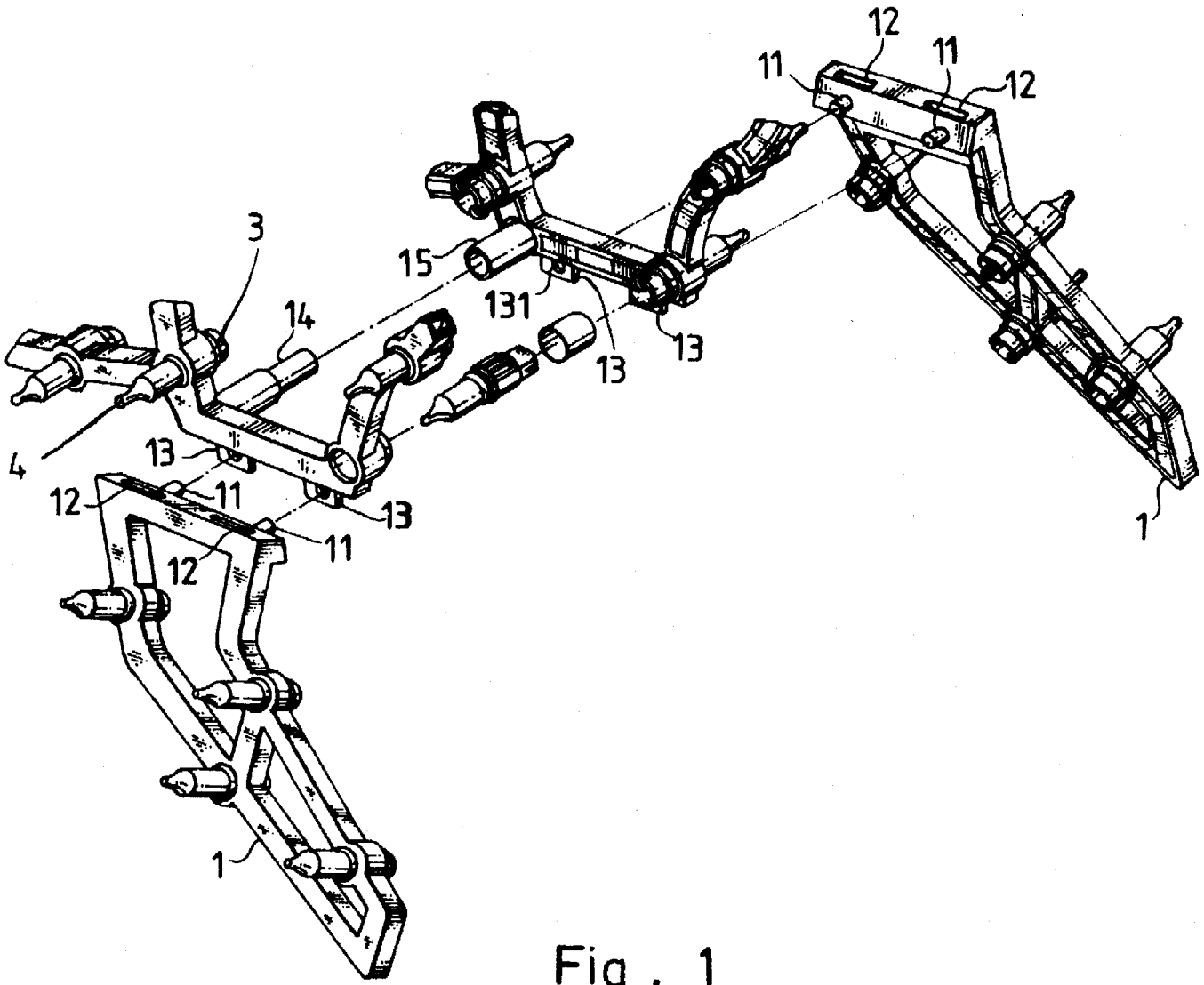
FIG. 1 is an exploded view of a part of the present invention.
Figure 2:
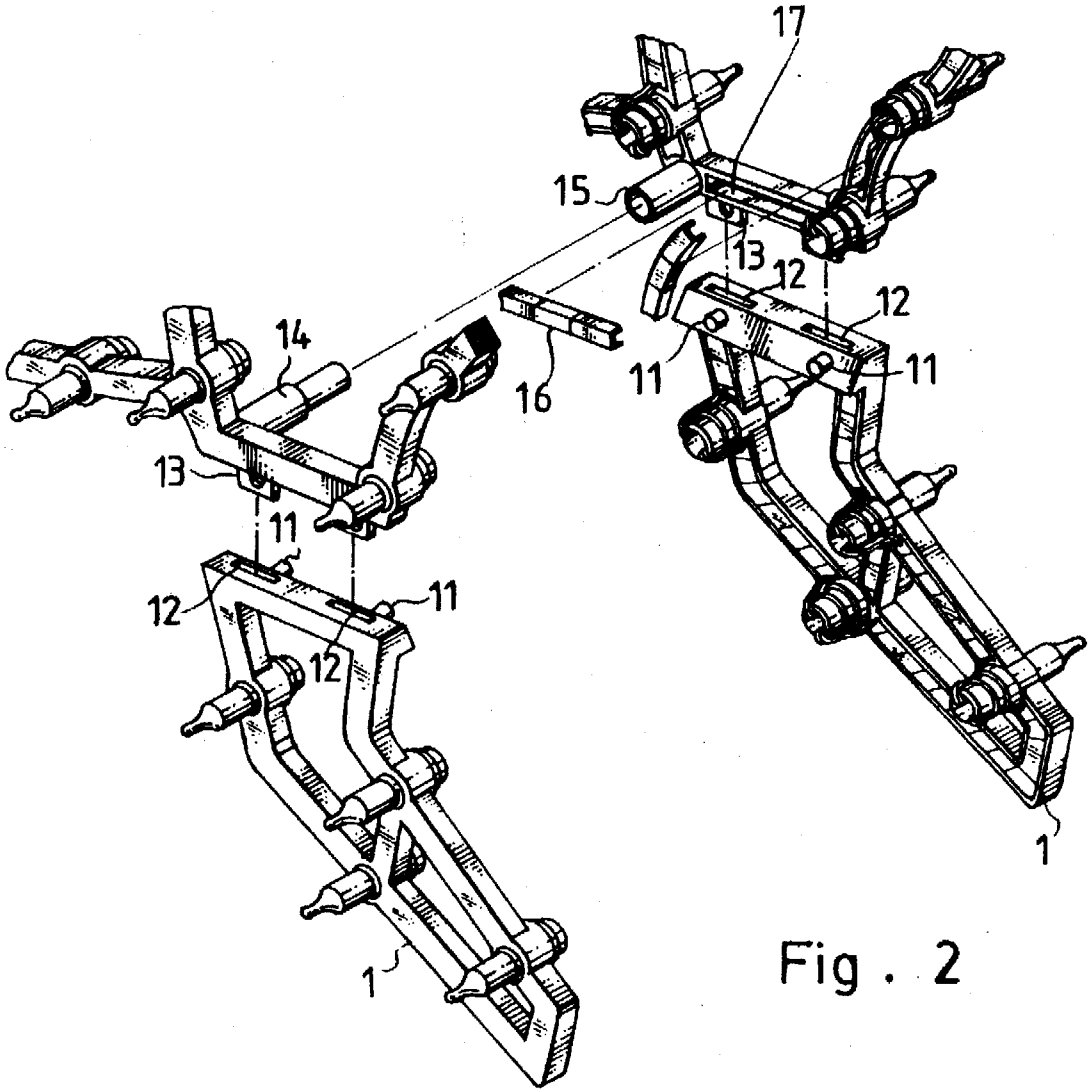
FIG. 2 is another exploded view of the present invention.
Figure 4:
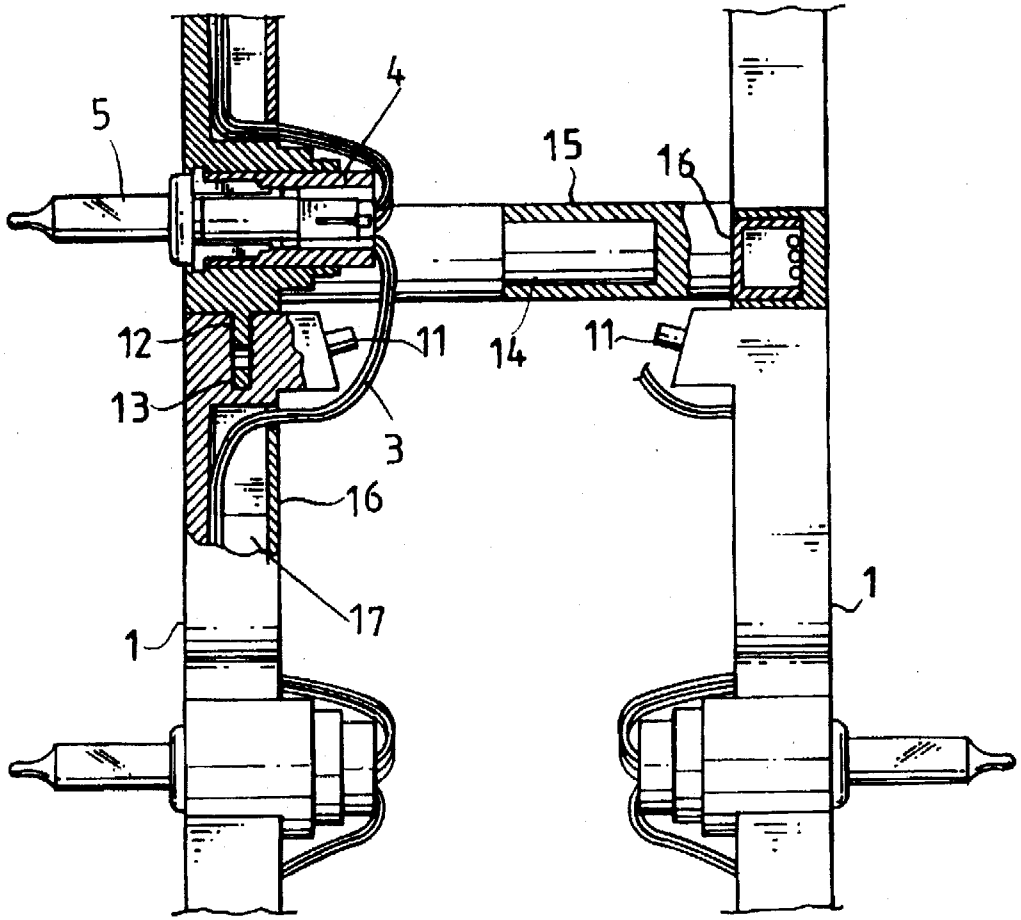
FIG. 4 shows two unit light carrier frames connected in parallel.

Each of the unit lamp carrier frames 1 comprises a plurality of plug holes 12 disposed in the periphery in X-axis direction, a plurality of lugs 13 raised from the periphery in X-axis direction and defining a respective coupling hole 131, a plurality of short plug rods 11 and stepped coupling rods 14 and coupling sockets 15 respectively raised from the back side in Y-axis direction, a plurality of wire grooves 17, which receive the electric wires 5, and a plurality of cover plates 16 respectively covered on the wire grooves 17 (see FIGS. 2 and 4). By fitting the lugs 13 of one unit lamp carrier frame 1 into the plug holes 12 of another, or fitting the short plug rods 11 of one unit lamp carrier frame 1 into the plug holes 12 of another, or fitting the short plug rods 11 of one unit lamp carrier frame 1 into the coupling holes 131 of the lugs 13 of another, the unit lamp carrier frames 1 can be connected to one another in a plane (see FIG. 3). By fitting the stepped coupling rods 14 of one unit lamp carrier frame 1 into the coupling sockets 15 of another, the unit lamp carrier frames 1 can be connected into a three-dimension structure (see FIGS. 4 and 6).

Referring Figures from 7 to 11, the electric plug 2 is comprised of a plastic housing 21, which comprises an insulative partition plate 212 longitudinally disposed in the middle, two parallel chambers 211 separated by the insulative partition plate 212, a front opening 213 in front of the parallel chambers 211, and two sliding grooves 2131 at two opposite sides of the front opening 213, two metal contact blades 22 and 23 respectively mounted in the parallel chambers 211 of the plastic housing 21 and having a respective raised portion 221 and 231, a metal connecting plate 24 transversely mounted in the parallel chambers 211 at an inner side and having two raised portions 241 respectively projecting into the parallel chambers 211, a packing plate 25 covered on the front opening 213 of the plastic housing 21 and having two opposite side flanges 251 and 252 respectively fitted into the sliding grooves 2131 of the plastic housing 21, and two cartridge fuses 26 respectively connected between the raised portion 221 and 231 of the metal contact blades 22 and 23, and the raised portions 241 of the metal connecting plate 24.

I claim:

1. A decorative light assembly comprising a plurality of unit lamp carrier frames connected together in different directions to form a decorative pattern, an electric plug adapted for connection to power supply, a plurality of lamp sockets mounted in said unit lamp carrier frames and connected in series to said electric plug by electric wires, and a plurality of bulbs respectively mounted in said lamp sockets, wherein: each of said unit lamp carrier frames comprises a plurality of plug holes disposed in the periphery in X-axis direction, a plurality of lugs raised from the periphery in X-axis direction and defining a respective coupling hole, a plurality of short plug rods and stepped coupling rods and coupling sockets respectively raised from a back side thereof in Y-axis direction opposite to said bulbs, a plurality of wire grooves at the back side, which receive said electric wires, and a plurality of cover plates respectively covered on said wire grooves, the lugs one unit lamp carrier frame being adapted for fitting into the plug holes of another unit lamp carrier frame, the short plug rods of one unit lamp carrier frame being adapted for fitting into the coupling holes of the lugs of another, the stepped coupling rods of one unit lamp carrier frame being adapted for fitting into the coupling sockets of another; said electric plug is comprised of a plastic housing, which comprises an insulative partition plate longitudinally disposed in the middle, two parallel chambers separated by said insulative partition plate, and a front opening in front of said parallel chambers, two metal contact blades respectively mounted in the parallel chambers of said plastic housing and adapted for connecting to an electric socket and having a respective raised portion, a metal connecting plate transversely mounted in the parallel chambers at an inner side and having two raised portions respectively projecting into the parallel chambers of said plastic housing, two cartridge fuses respectively mounted inside the parallel chamber of said plastic housing and electrically connected between the raised portions of said metal contact blades and the raised portions of said metal connecting plate, and a packing plate covered on the front opening of said plastic housing to hold said cartridge fuses inside said plastic housing and to prohibit outside water from passing to the inside of said plastic housing.

2. The decorative light assembly of claim 1 wherein said plastic housing comprises two sliding grooves at two opposite sides of the front opening thereof; said packing plate has two flanges at two opposite sides respectively fitted into the sliding grooves of said plastic housing.

* * * * *